US007270285B2

(12) United States Patent
Roberts

(10) Patent No.: US 7,270,285 B2
(45) Date of Patent: Sep. 18, 2007

(54) BAND CUTTING SYSTEM

(75) Inventor: Steven L. Roberts, Klamath Falls, OR (US)

(73) Assignee: Blue Sheep LLC, Grants Pass, OR (US)

( * ) Notice: Subject to any disclaimer, the term of this patent is extended or adjusted under 35 U.S.C. 154(b) by 164 days.

(21) Appl. No.: 11/135,821

(22) Filed: May 24, 2005

(65) Prior Publication Data

US 2006/0266859 A1 Nov. 30, 2006

(51) Int. Cl.
*B02C 18/16* (2006.01)

(52) U.S. Cl. ..... 241/100; 83/349; 241/222; 241/242

(58) Field of Classification Search ..... 241/242, 241/243, 222, 224, 100; 83/349
See application file for complete search history.

(56) References Cited

U.S. PATENT DOCUMENTS 1,423,867 A 7/1922 Mitts et al.
1,936,025 A 11/1933 Mahaffey
3,236,723 A 2/1966 Whiteside
3,813,048 A 5/1974 Lehr
4,028,779 A 6/1977 Shah
4,239,160 A 12/1980 Hawkins et al.
4,545,539 A 10/1985 Steffensen
4,801,101 A 1/1989 Dreyer et al.
5,359,915 A 11/1994 Hitz
5,383,616 A 1/1995 Svaighert
5,454,523 A 10/1995 Matsuda
5,996,457 A 12/1999 Wingeron, Jr.
6,209,432 B1 4/2001 Matsuda
6,450,430 B2 9/2002 Dykstra et al.
6,474,575 B1 11/2002 Gramling, III
6,978,956 B2 * 12/2005 Maynard ..... 241/224

* cited by examiner

*Primary Examiner*—Mark Rosenbaum
(74) *Attorney, Agent, or Firm*—McNees Wallace & Nurick LLC

(57) ABSTRACT

A cutting system for cutting elongate bands of material is provided. The cutter includes a cutter and a motor connected to the cutter for rotatably driving the cutter. A tube surrounds the cutter at a predetermined spacing from the motor, the tube including an opening having a bladed portion, the bladed portion and tube being of unitary construction. The cutter and bladed portion are immediately adjacent for cutting segments from a band of material disposed between the cutter and bladed portion.

18 Claims, 7 Drawing Sheets

Figure 8
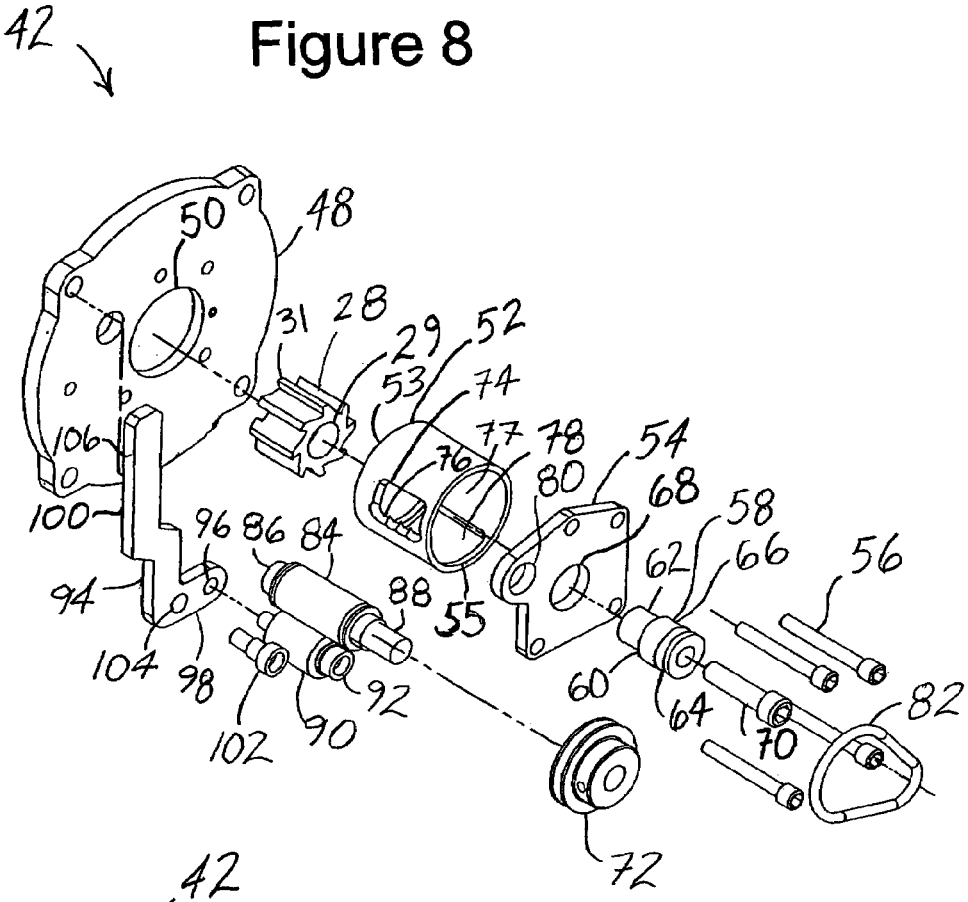
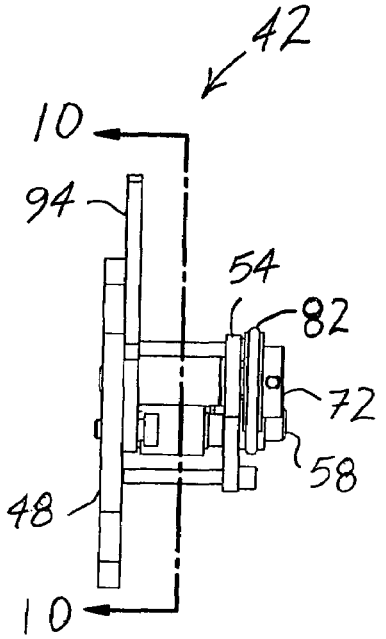
Figure 9

BAND CUTTING SYSTEM

FIELD OF THE INVENTION

The present invention is directed to a cutting system, and more particularly, is directed to a cutting system for cutting elongate bands of material.

BACKGROUND OF THE INVENTION

To help safeguard containers during shipping, elongate bands of material, such as plastic or metal, also referred to as banding or banding material, are wrapped about the peripheries of the containers. However, upon arrival at the desired destination, the banding is cut and contents of the containers removed. While the containers can usually be reused, it is typically not practical to reuse the banding. Further, since the banding can maintain the peripheral profile of the container previously secured, it can be difficult to effectively dispose of the banding.

What is needed is a band cutting system that cuts the banding into small segments for convenient disposal, the band cutting system being portable, inexpensive to purchase and use, and both simple and safe to operate.

SUMMARY OF THE INVENTION

The present invention relates to a cutting system including a cutter and a motor connected to the cutter for rotatably driving the cutter. A tube surrounds the cutter at a predetermined spacing from the motor, the tube including an opening having a bladed portion, the bladed portion and tube being of unitary construction. The cutter and bladed portion are immediately adjacent for cutting a segment from a band of material disposed between the cutter and bladed portion.

The present invention further relates to a cutting system including a cutter and a motor connected to the cutter for rotatably driving the cutter, the motor secured to a base and a container secured to the base. A tube surrounds the cutter at a predetermined spacing from the motor, the tube including an inlet having a bladed portion and a discharge, the inlet, discharge and tube being of unitary construction, the container in communication with the discharge. The cutter and bladed portion are immediately adjacent for cutting segments from a band of material disposed between the cutter and bladed portion, the segments passing through the discharge and accumulating in the container.

An advantage of the present invention is that it is of compact, portable construction.

A further advantage of the present invention is that it is inexpensive to fabricate.

A yet additional advantage of the present invention is that it is inexpensive to operate.

A further advantage of the present invention is that it is easy to operate.

A still further advantage of the present invention is that it is safe to operate.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 8 is a partial exploded perspective view of a cutting subassembly of a band cutting system of the present invention.

FIG. 9 shows a front view of the assembled cutting subassembly of FIG. 8 of the present invention.

Wherever possible, the same reference numbers will be used throughout the drawings to refer to the same or like parts.

DETAILED DESCRIPTION OF THE INVENTION

Figure 1:
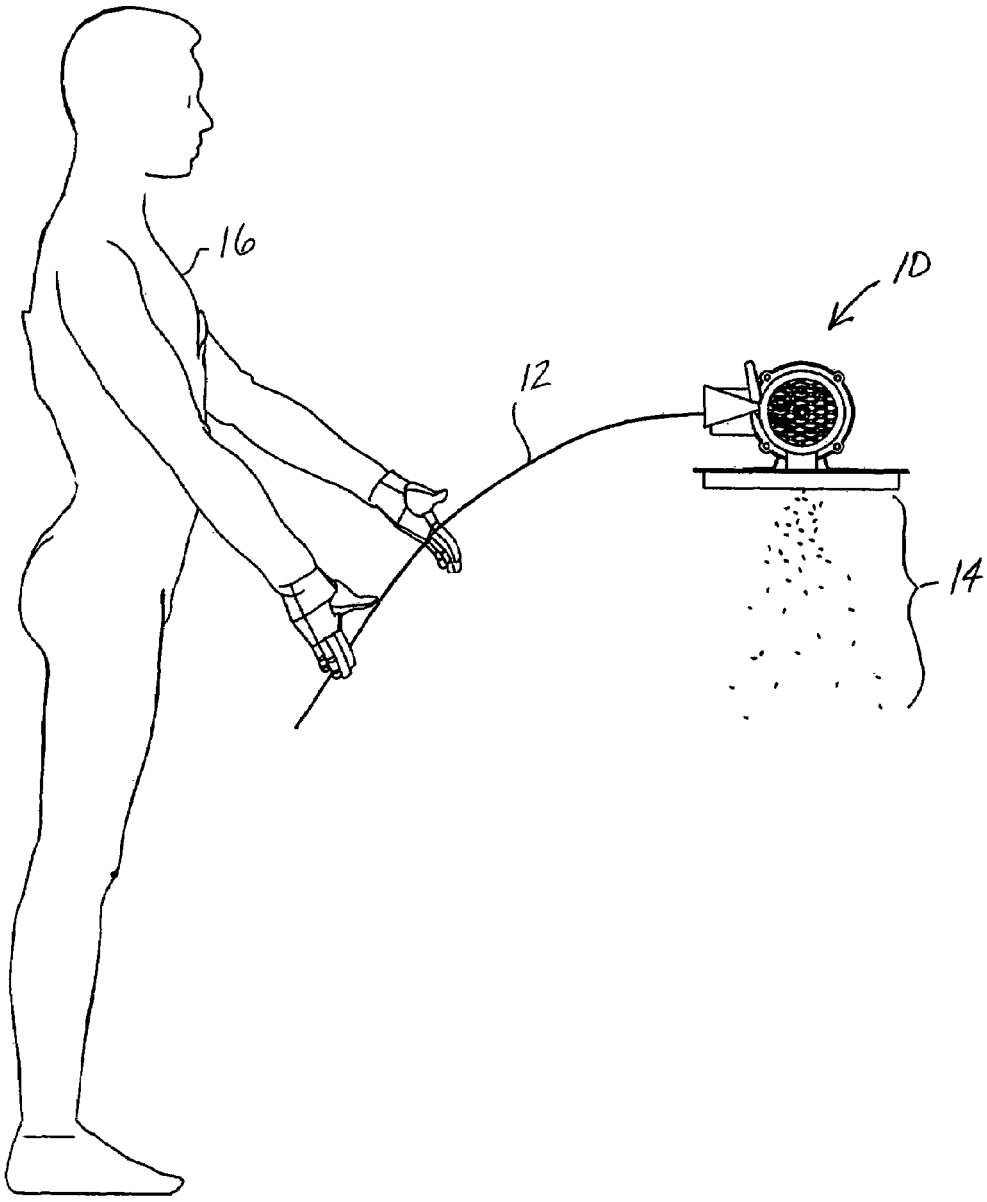
FIG. 1 is a side view of a band cutting system of the present invention.
Figure 2:
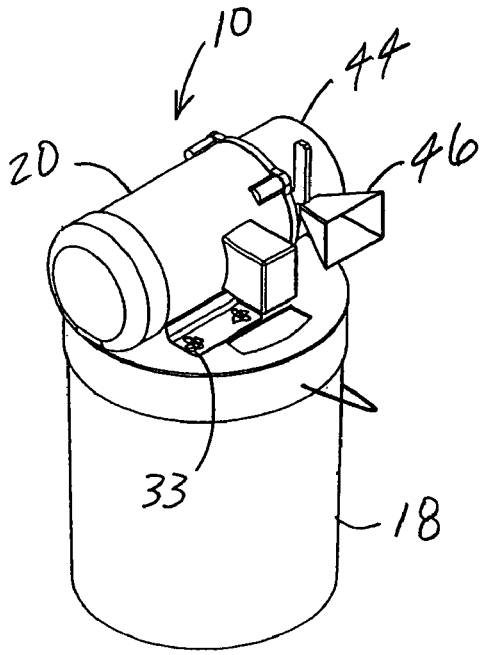
FIGS. 2 and 3 are opposed perspective views of a band cutting system of the present invention.
Figure 3:
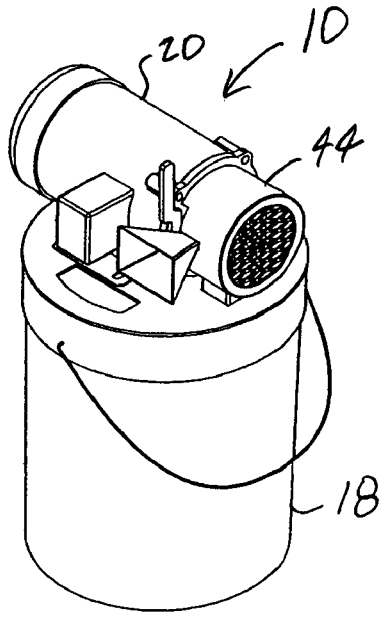
Figure 4:
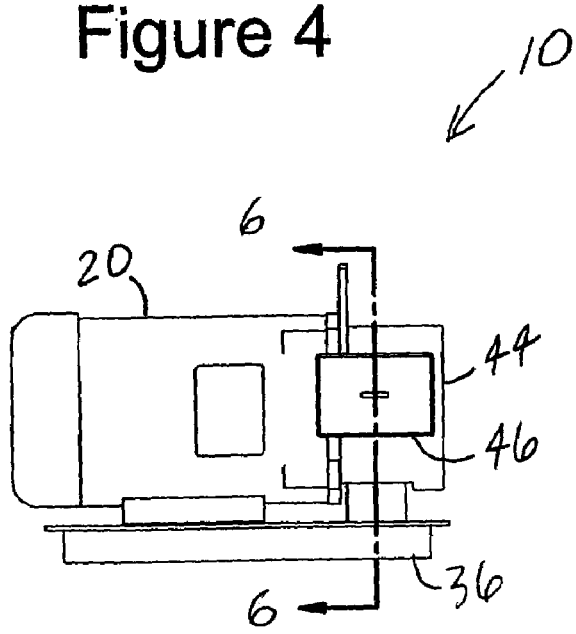
FIGS. 4 and 5 are respective front and side views of a band cutting system of the present invention.
Figure 5:
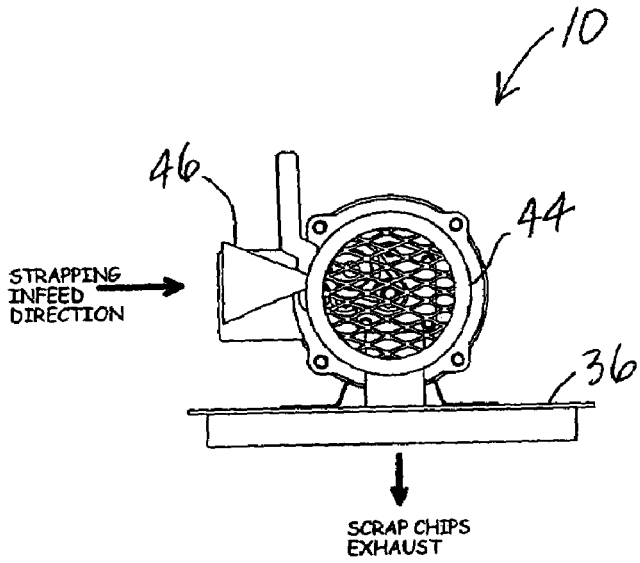
Figure 6:
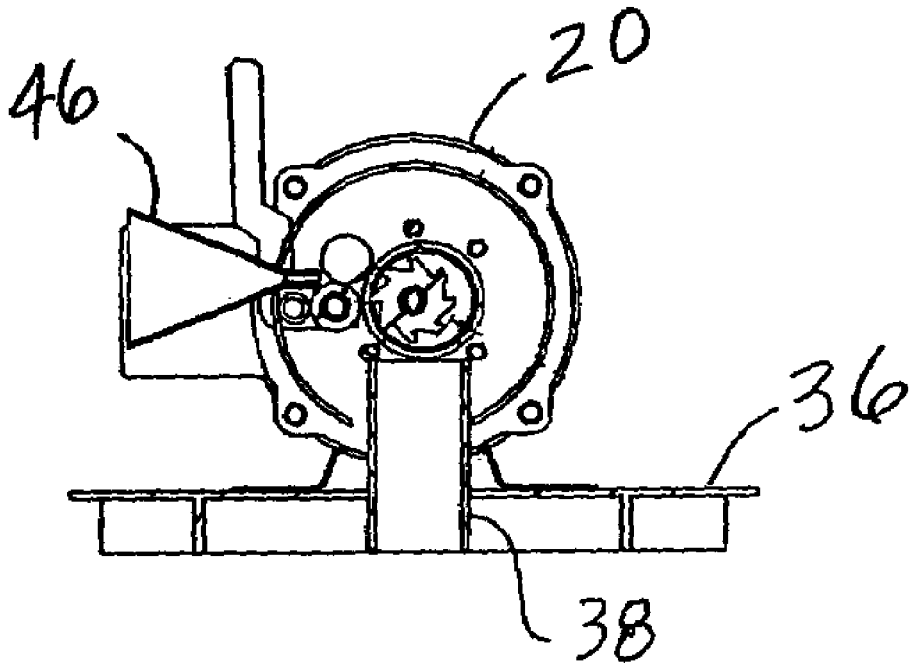
FIG. 6 is a cross section of a band cutting system taken along line 6-6 of FIG. 4 of the present invention.
Figure 7:
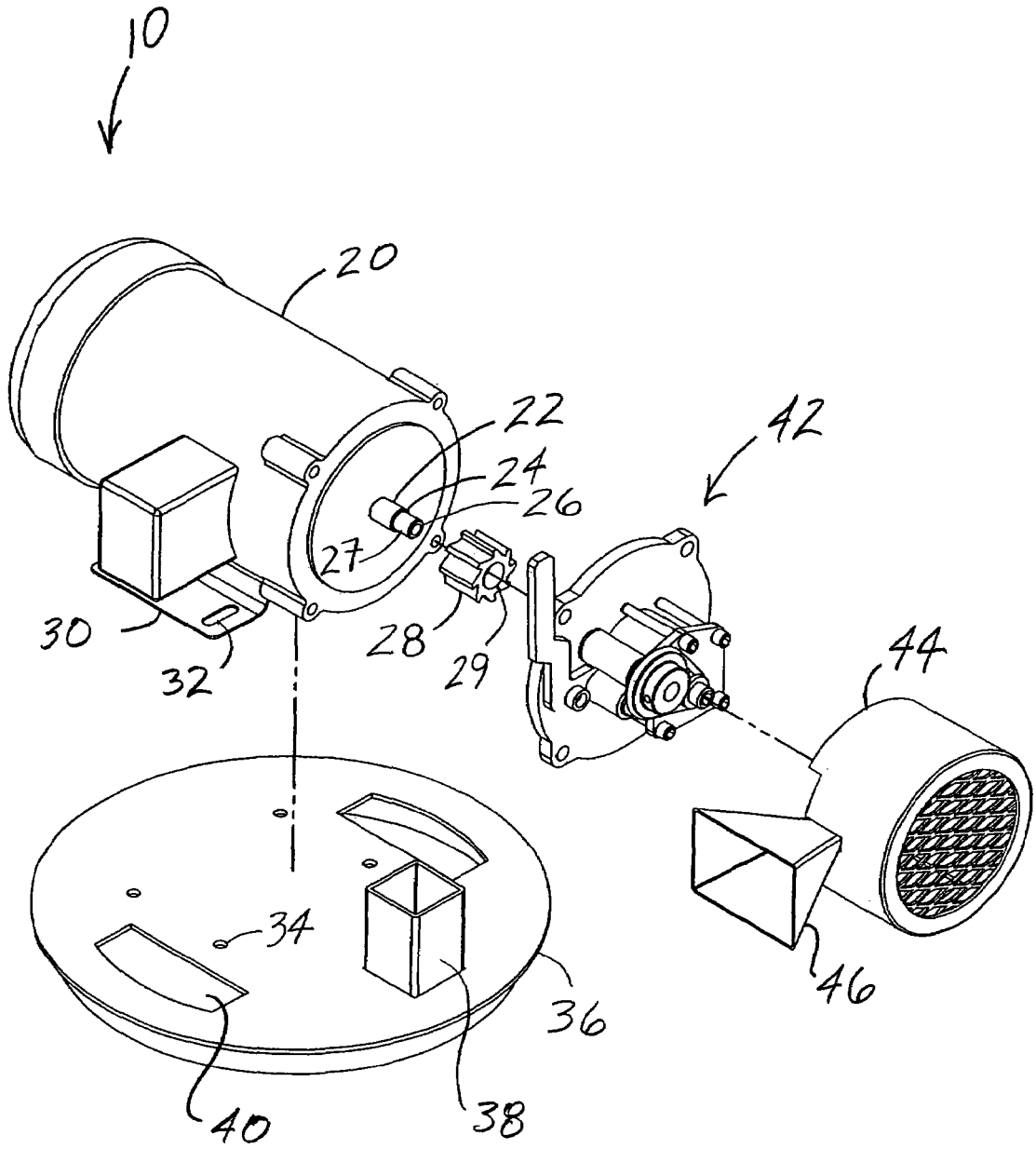
FIG. 7 is an exploded perspective view of a band cutting system of the present invention.

One embodiment of a cutting system 10 is shown in FIG. 1. Preferably, cutting system 10 receives one or more bands 12, typically composed of metal, nonmetal, or nonmetal fibers, cutting the bands 12 to substantially uniformly sized segments 14, also referred to as chips, for convenient disposal. Although the size of the cutting system 10 can range widely, in a preferred embodiment, as shown in FIG. 1, with an operator 16, the cutting system 10 is extremely compact and portable for convenience and economical to produce. For example, referring to FIGS. 2 and 3, the cutting system 10 can be configured for use with commonly available bailed containers 18, such as a 5-gallon container. However, the cutting system 10 can be configured for use with any compatible container.

Referring to FIGS. 1-7, the cutting system 10 includes a motor 20, such as a standard industrial one horsepower, 1250 r.p.m., 115 volt ac, c-face motor. However, it is to be understood that motors sized considerably larger or smaller having different operating specifications can also be used. A shaft 22 extends from the motor 20 for rotatably driving a cutter 28, the shaft 22 including a shoulder 24 that extends to a narrow portion 27 having a threaded aperture 26 formed therein. Narrow portion 27 is directed into an aperture 29 of cutter 28 until the cutter 28 abuts shoulder 24. Cutter 28 is then secured to a cutter subassembly 42 which is covered by a housing 44 having an inlet chute 46 as will be discussed in further detail below. Preferably, motor 20 also includes a pair of opposed legs 30 having slots 32 formed therein for alignment with apertures 34 in a base 36, the apertures 34 and slots 32 receiving fasteners 33 to secure the motor 20 and base 36 together. The base 36 includes at least one opening 40 to permit convenient monitoring of the level of banding chips 14 accumulating in the container 18 secured beneath the base 36 of the cutting system 10. Preferably, a discharge chute 38 extends upwardly from an upper surface of the base 36 to guide chopped banding chips 14 from the cutter subassembly 42 through the base 36 and into the container 18.

Referring to FIGS. 1, and FIGS. 7-11, cutter subassembly 42 includes a plate 48 that is preferably secured to the motor 20. Plate 48 has an aperture 50 that is aligned with the motor shaft 22. Plate 48 is secured to the motor 20, the narrow portion 27 of motor shaft 22 extending inside aperture 29 of the cutter 28 until the cutter 28 abuts the shoulder 24 of shaft 22. A tube 52 surrounds the cutter 28. Tube 52 includes an inlet or opening 74 having a bladed portion 76 and an opening or discharge 78. Preferably the bladed portion 76 includes a serrated blade. When the cutter 28 is directed into rotational motion by motor 20, fluted blades 31 of the cutter 28 and the bladed portion 76 are brought into and out of immediate adjacency such that banded material 12 directed into the opening 74 of tube 52 is cut or severed between the bladed portion 76 and a fluted blade 31 of the cutter 28. For clarity, the term "immediately adjacent" refers to the aligned position between a fluted blade 31 of the cutter 28 and the bladed portion 76 during which the fluted blade 31 and bladed portion 76 cut or sever a segment 14 from the banding 12. The chopped banding material segments 14 are discharged from the tube 52 through opening 78.

Figure 10:
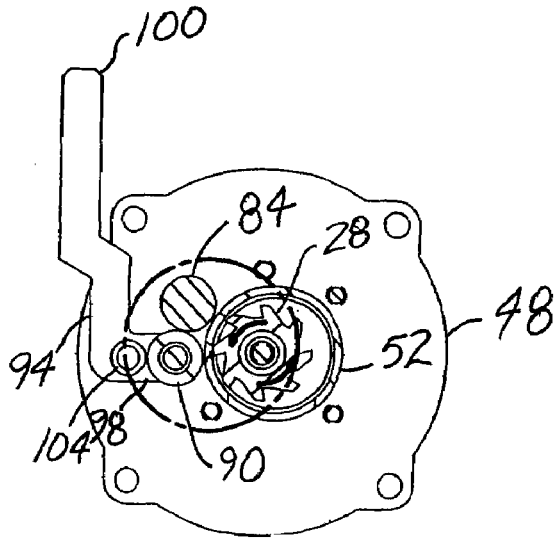
FIG. 10 is a cross section of the assembled cutting subassembly taken along line 10-10 of FIG. 9 of the present invention.
Figure 11:
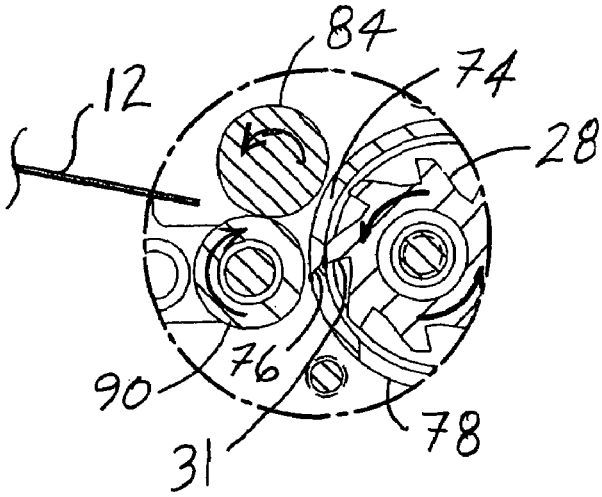
FIG. 11 is an enlarged, partial cross section of FIG. 10 the cutting subassembly of the present invention.

Preferably, to secure tube 52 in position, one end 53 of the tube 52 extends through aperture 50 of the plate 48 and abuts the motor 20, while the other end 55 of the tube 52 abuts a plate 54. Fasteners 56 extending through apertures formed in plate 54 secure the plate 54 to plate 48, compressing tube 52 therebetween. In a preferred embodiment, the diameter of aperture 50 and the outer diameter of the tube 52 are sized to provide a desired spacing between bladed portion 76 of the tube 52 and the fluted blades 31 of the cutter 28 when the fluted blades 31 and the bladed portion 76 are immediately adjacent. As shown in FIG. 10, the respective centers of the cutter 28 and the tube 52 are offset from one another, although such offset is not required if the diameter of the cutter 28 is substantially the same as the inside diameter of the tube 52. However, it is preferred that the diameter of the cutter 28 is not substantially the same as the inside diameter of the tube 52, since the increased spacing between the fluted blades 31 and the inside surface 77 of the tube 52 permits the banding material segments 14 to more readily pass through opening 78 of the tube 52.

To secure the cutter 28 in its desired position against the shoulder 24 of the motor shaft 22, a shaft portion 62 of a sheave 58 is directed through an aperture 68 of plate 54 and inside the aperture 29 opposite shoulder 24. Shaft portion 62 extends to a shoulder 60, then to an enlarged diameter portion 66, and finally extends to a grooved portion 64. By directing shaft portion 62 inside the aperture 29 until the shoulder 60 abuts the cutter 28, the cutter 28 is secured along opposite surfaces between shoulders 24, 60. Additionally, the diameter of the enlarged diameter portion 66 of sheave 58 and the diameter of aperture 68 of the plate 54, which diameters are adjacent to each other upon assembly, are sized so that banding material segments 14 cannot pass therebetween. A fastener 70 is directed through the sheave 58 and into threaded engagement with the threaded aperture 26 formed in the motor shaft 22 to secure the position of the sheave 58 with respect to the cutter 28.

A band 82 engages the grooved portion 64 of sheave 58, the band 82 also engaging a sheave 72. Band 82, which is urged into rotational movement by the grooved portion 64 of sheave 58 that is likewise urged into rotational movement by the motor shaft 22, urges sheave 72 into rotational movement. Sheave 72 is connected to an end 88 of a feed roller 84, the other end 86 of the feed roller 84 being connected to the plate 48. A second feed roller 90 is controllably placed in rolling engagement with feed roller 84. Preferably, a fastener 92 that extends through feed roller 90 threadedly engages an aperture 96 of a feed release lever 94. Feed release lever 94 is preferably pivotally connected to plate 48 by a fastener 102 that extends through an aperture 104 in the feed release lever 94. Feed roller 90 is secured to a lever arm 98 that extends from aperture 96 to aperture 104, while a second lever arm 100 extends from aperture 104 to an end 106 of arm 100. By directing end 106 of lever 94 away from cutter 28, feed roller 90, which pivots along arm 98 about aperture 104, is brought into rolling contact with feed roller 84. Counter rotating feed rollers 84, 90 draw banding 12 that is directed through chute 46 of the housing 44 surrounding the cutter subassembly 42 into the opening 74 of the tube 52, wherein the banding 12 is cut or severed into banding segments 14 (FIG. 1) between the bladed portion 76 and a fluted blade 31 of the cutter 28. Similarly, by directing end 106 of lever 94 toward cutter 28, feed roller 90 is brought out of rolling contact with feed roller 84, which halts the feeding of banding 12 into the band cutting system 10 by feed rollers 84, 90.

One function of the feed rollers 84, 90 is to safely control the rate banding 12 is fed into the band cutting system 10. In a preferred embodiment, the band cutting system 10 can have a feed rate of at least about 150 feet of banding 12 per minute. The feed rate depends upon the rotational speed of the motor 20, the ratios of the grooved portions of respective sheaves 58, 72 and the diameter of the feed roller 84. In case a problem develops during operation of the cutting system 10, by actuating arm 100 toward the cutter 28, feed rollers 84, 90 no longer feed banding 12 into the cutting subassembly 42 as previously discussed.

There is a predetermined relationship between the size of the banding segments 14 when the banding is fed into the band cutting system 10 through the feed rollers 84, 90. This relationship depends upon the ratios of the grooved portions of the respective sheaves 58, 72, the number of fluted blades 31 of the cutter 28 and the diameter of the driven feed roller 84, if the cutter 28 and sheave 58 are driven at the same rotational speed as with the construction shown in FIG. 8. In a preferred embodiment, the cutter 28 has eight fluted blades 31, such as commonly used in milling machines, although cutters can have more blades or less blades than eight. With properly configured sheaves 58, 72 and feed roller 84, the length of banding segments 14 produced can be less than one eighth of an inch, if desired, or longer. By producing one eighth inch segments, it is possible to reduce a volume of 30 cubic yards of loose banding to less than 100 gallons (dry, US measurement standard) which represents a reduction in volume, or ratio of compaction, of greater than 52:1.

The operation of the band cutting system 10 is now discussed. Power from a power source (not shown) is provided to the motor 20 to urge the motor shaft 22 into rotational movement. The motor shaft 22 urges both the cutter 28 inside tube 52 and sheave 58 into rotational movement. The sheave 58 then urges sheave 72 into rotational movement via band 82. Sheave 72 urges feed roller 84 into rotational movement. Sufficiently directing arm 100 of lever 94 away from the cutter 28 brings feed roller 90 into contact with feed roller 84, feed roller 84 urging feed roller 90 into rotational movement. Banding material 12 directed into the inlet chute 46 of the housing 44 surrounding the cutter subassembly 42 is drawn between the counter rotating feed rollers 84, 90 and controllably directed into the opening 74 of tube 52. Banding material 12 entering the opening 74 is cut or severed into banding segments 14 between the bladed portion 76 and the fluted blades 31 of the cutter 28, the banding segments 14 being directed through the opening 78 of tube 52 and then through the discharge chute 38 in the base 36 for collection in the container 18 which supports the base 36. The amount of collected banding segments 14 accumulating in the container 18 can be easily monitored through viewing openings 40.

It is to be understood that the band cutting system of the present invention can accept more than one band of material simultaneously and further, that the banding material can be either metal, nonmetal or fibers.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cutting system for cutting a band of material comprising:

a cutter having at least one blade;

a motor connected to the cutter for rotatably driving the cutter;

a tube surrounding the cutter at a predetermined spacing from the motor, the tube including an opening having a bladed portion, the bladed portion and tube being of unitary construction, the cutter and bladed portion being immediately adjacent for cutting a segment from the band of material disposed between the cutter and bladed portion; and wherein the at least one blade and the opening having orientation providing a plurality of cutting points separated from one another for substantially simultaneously cutting the segment.

2. The cutting system of claim 1 wherein the cutting system is portable.

3. The cutting system of claim 1 wherein the motor is secured to a base.

4. The cutting system of claim 3 wherein the base is secured to a container.

5. The cutting system of claim 4 wherein the container supports the base.

6. The cutting system of claim 5 wherein the base includes a discharge chute, the discharge chute configured and disposed to direct cut segments into the container.

7. The cutting system of claim 6 wherein the base includes at least one opening for monitoring a level of cut segments accumulating in the container.

8. The cutting system of claim 1 further comprises a pair of feed rollers for controllably feeding band material between the cutter and bladed portion.

9. The cutting system of claim 8 wherein the pair of feed rollers can be disengaged to halt feeding band material between the cutter and bladed portion.

10. The cutting system of claim 8 wherein cut segments are less than about one eighth inch in length.

11. The cutting system of claim 8 wherein cut segments are more than about one eighth inch in length.

12. The cutting system of claim 1 wherein centers of the cutter and tube are offset from each other.

13. A cutting system for cutting a band of material comprising:

a cutter having at least one blade;

a motor connected to the cutt er for rotatably driving the cutter, the motor secured to a base;

a container secured to the base;

a tube surrounding the cutter at a predetermined spacing from the motor, the tube including an inlet having a bladed portion and a discharge, the inlet, discharge and tube being of unitary construction, the container in communication with the discharge, the cutter and bladed portion being immediately adjacent for cutting segments from the band of material disposed between the cutter and bladed portion, the segments passing through the discharge and accumulating in the container; and wherein the at least one blade and the inlet having orientation providing a plurality of cutting points separated from one another for substantially simultaneously cutting the segments.

14. The cutting system of claim 13 wherein the container supports the base.

15. The cutting system of claim 13 wherein the base includes at least one opening for monitoring a level of the accumulating segments.

16. The cutting system of claim 13 wherein the cutting system is portable.

17. The cutting system of claim 13 further comprises a pair of feed rollers for controllably feeding band material between the cutter and bladed portion.

18. The cutting system of claim 13 wherein the pair of feed rollers can be disengaged to halt feeding band material between the cutter and bladed portion.

* * * * *